US007533831B2

(12) United States Patent
Cooke

(10) Patent No.: US 7,533,831 B2
(45) **Date of Patent: *May 19, 2009**

(54) FUEL INJECTOR

(75) Inventor: Michael Peter Cooke, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 120 days.

This patent is subject to a terminal disclaimer.

(21) Appl. No.: 11/334,116

(22) Filed: Jan. 18, 2006

(65) Prior Publication Data

US 2006/0157593 A1 Jul. 20, 2006

(30) Foreign Application Priority Data

Jan. 19, 2005 (EP) ..... 05250253

(51) Int. Cl.
*B05B 1/08* (2006.01)

(52) U.S. Cl. ..... 239/102.2; 239/444; 239/556; 239/533.9; 239/533.12; 239/584; 239/96

(58) Field of Classification Search ..... 239/102.2, 239/436, 444, 533.4, 533.9, 556, 548, 584, 239/533.12, 96
See application file for complete search history.

(56) References Cited

U.S. PATENT DOCUMENTS 4,382,554 A * 5/1983 Hofmann ..... 239/533.9
5,899,389 A * 5/1999 Pataki et al. ..... 239/533.9
6,557,776 B2 * 5/2003 Carroll et al. ..... 239/533.9
6,769,634 B2 * 8/2004 Brenk et al. ..... 239/533.12
7,143,964 B2 * 12/2006 Kuegler ..... 239/533.12
7,159,799 B2 * 1/2007 Cooke ..... 239/533.12
2004/0144364 A1 * 7/2004 Kuegler ..... 239/88

FOREIGN PATENT DOCUMENTS

DE 10315820 5/2004
DE 10315821 5/2004
DE 10254186 6/2004
DE 10306808 9/2004

(Continued)

*Primary Examiner*—Steven J Ganey
(74) *Attorney, Agent, or Firm*—Thomas W. Twon

(57) ABSTRACT

A fuel injector having an injection nozzle comprising a nozzle body being provided with a nozzle bore, an outer valve received within the nozzle bore and being engageable with a first seating to control fuel delivery through a first set of one or more nozzle outlets. The outer valve is provided with an outer valve bore within which an inner valve is received the inner valve being engageable with a second seating to control fuel delivery through a second set of one or more nozzle outlets. The fuel injector further includes an injection control chamber for fuel and pressure control means for controlling the pressure of fuel within the injection control chamber. A first surface associated with the inner valve and a second surface associated with the outer valve are exposed to fuel pressure within the injection control chamber, wherein the first and second surfaces are arranged such that when the pressure of fuel within the injection control chamber is increased to a relatively high pressure, one of the outer valve or the inner valve is caused to disengage its respective seating and when the pressure of fuel with the injection control chamber is reduced to a relatively low pressure, the other of the outer valve or the inner valve is caused to disengage its respective seating.

17 Claims, 13 Drawing Sheets

FOREIGN PATENT DOCUMENTS

| | | |
|---|---|---|
| DE | 10322826 | 12/2004 |
| EP | 0967383 | 12/1999 |
| EP | 1063415 | 12/2000 |
| EP | 1344929 | 9/2003 |
| WO | WO 2004044415 A1 * | 5/2004 |

* cited by examiner

FUEL INJECTOR

The present invention relates to a fuel injector for use in a fuel injection system for an internal combustion engine. More particularly, although not exclusively, the present invention relates to a fuel injector for use in a compression ignition internal combustion engine in which first and second valve needles are operable to control the injection of fuel into a combustion space through a plurality of nozzle outlets.

So-called "variable orifice nozzles" (VONs) enable the number of orifices that are used to inject fuel into the combustion space to be varied for different engine loads. Typically, such a nozzle includes a nozzle body which is provided with a blind bore within which a first, outer valve needle is moveable under the control of an actuator. The nozzle body bore defines a seating surface with which the outer valve needle is engageable to control fuel injection through a first set of nozzle outlets provided at a first axial position in the wall of the nozzle body. The outer valve needle itself is provided with a longitudinally extending bore opening at the valve tip and within which a second, inner valve needle is moveable. The inner valve needle projects from the opening of the outer valve needle and is engageable with the seating surface to control fuel injection through a second set of outlets provided at a second, lower axial position in the wall of the nozzle body.

In a known injection nozzle of this type, as described in the Applicant's co-pending European patent application no. EP 04250928.1, the fuel flow to a first (upper) set of nozzle outlets is controlled by an outer valve needle and the fuel flow to a second (lower) set of nozzle outlets is controlled by an inner valve needle. In order to deliver fuel through the upper outlets, the outer valve needle alone is operable to disengage its seating but the inner valve needle remains seated. In order to deliver fuel through the lower outlets in addition to the upper outlets, the outer valve needle is permitted to move beyond a pre-determined distance such that its movement is transmitted to the inner valve needle, so causing the inner valve needle to disengage or lift from its seating. During this stage of operation, both the first and second sets of outlets are opened to provide a relatively high fuel delivery rate.

An injection nozzle of this type enables selection of a small total nozzle outlet area in order to optimise engine emissions at relatively low engine loads. On the other hand, a large total nozzle outlet area may be selected so as to increase the total fuel flow at relatively high engine loads.

Due to the sequence in which the valve needles are lifted away from their associated seating surfaces, the fuel delivery characteristic tends to resemble a so-called "boot-shaped" profile (as can be seen from FIG. 1A) which is characterised by a graduated increase in fuel delivery and a sharp delivery cut-off at the end of the injection event. A boot-shaped injection rate is recognised as benefiting exhaust emissions and engine noise. However, in certain applications it is recognised that a "square-shaped" injection characteristics, as shown in FIG. 1B, is preferred and this is not readily achievable using known nozzle designs of the type described.

It is against this background that the present invention aims to provide an improved fuel injector.

According to a first aspect of the present invention there is provided a fuel injector for use in an internal combustion engine, the fuel injector having an injection nozzle comprising a nozzle body provided with a nozzle bore, an outer valve member received within the nozzle bore and being engageable with a first seating region to control fuel delivery through a first set of one or more nozzle outlets. The outer valve member itself is provided with an outer valve bore, within which an inner valve member is received, the inner valve member being engageable with a second seating region to control fuel delivery through a second set of one or more nozzle outlets. The injector further comprises an injection control chamber for fuel and pressure control means for controlling the pressure of fuel within the injection control chamber. A first surface associated with the inner valve member and a second surface associated with the outer valve member are exposed to fuel pressure within the injection control chamber. The first and second surfaces are arranged such that when the pressure of fuel within the injection control chamber is increased to a relatively high pressure, one of the outer valve member or the inner valve member is caused to disengage its respective seating region and when the pressure of fuel with the injection control chamber is reduced to a relatively low pressure, the other of the outer valve member or the inner valve member is caused to disengage its respective seating region.

In a preferred embodiment, the control chamber is arranged so that a decrease in fuel pressure within the injection control chamber causes the outer valve member to disengage the first seating region and wherein an increase in fuel pressure within the injection control chamber causes the inner valve member to disengage the second seating region.

In previously proposed designs of piezoelectric fuel injectors, the piezoelectric stack is de-energised from a relatively high voltage level, of 200V for example, to a low voltage level, for example 0V, in order to initiate injection. Since fuel delivery only accounts for a small percentage of the total running time of a given injector, the stack is maintained at a high voltage level for a large proportion of injector operation. This may give rise to adverse effects such as gradual ion migration within the piezoelectric material of the stack which, over time, can reduce the efficiency of the piezoelectric stack or even result in complete actuator failure due to electrical flashovers.

The present invention provides the flexibility to selectively inject through the first and second set of outlets whilst reducing the effects of relatively high average applied voltages. In order to commence injection through either set of outlets, the piezoelectric stack is energised or de-energised to high or low voltage levels relative to an intermediate or nominal holding voltage. For example, during non-injection the piezoelectric stack may be held at a nominal voltage, for example 80V. In order to lift the inner valve member, the stack may be energised to a relatively high level, for example 200V, and in order to lift the outer valve member, the stack may be de-energised to a relatively low level, for example −20V. As a result, the long term average DC voltage on the piezoelectric stack is reduced which guards against premature deterioration of the material from which the piezoelectric stack is formed.

The invention is particularly suited to fuel injection systems operating on the principle of Homogeneous Charge Compression Ignition (HCCI) with the aim of reducing harmful exhaust emissions. Since the invention enables injection selectively through either the first or the second set of outlets, or indeed both simultaneously in some embodiments, the included angles of each set of outlets may individually be chosen so as to optimise emissions during both low load and full load operating conditions.

Although the outer valve member and the inner valve member may move independently from one another, in a preferred embodiment the fuel injector may further include coupling means to couple movement of the outer valve member to the inner valve member when the outer valve member is moved away from the first seating region.

In practice, it is convenient for the inner valve member to be coupled securely to an inner valve carrier member, the first surface being defined by the carrier member. However, it should be appreciated that the inner valve member and the valve carrier may also be a unitary part.

The coupling means preferably includes an abutment surface, associated with the outer valve member, which is engageable with a cooperable surface associated with the inner valve member. The abutment surface may be formed by a suitable projection defined by the outer valve member. However, it is preferred that the abutment surface is provided by an annular stop member received within the bore of the outer valve member, the abutment surface abutting the cooperable surface when both the outer valve member and the inner valve member are seated.

The annular stop member may also define a second surface which is spaced apart by a predetermined distance from a shoulder defined by the inner valve member. Thus, the second surface serves to prevent movement of the inner valve member away from its seating region by an amount greater than the predetermined distance.

Although the pressure control means may include any device for controlling the pressure of fuel within the injection control chamber, preferably the pressure control means comprises a piezoelectric actuator including a stack of piezoelectric elements having a stack length. Still preferably, the piezoelectric actuator is arranged within an accumulator volume for receiving fuel at injection pressure. The preferred mode of operation is for an increase in the length of the stack to cause an increase in fuel pressure within the control chamber and a reduction in the length of the stack to cause a reduction of fuel pressure within the control chamber.

The pressure control means may further include a control piston having a surface defining the control volume, together with the first and second surfaces, and wherein the control piston is operable to control the volume of the control chamber. In order to ensure that the inner valve member is biased into engagement with its seating region, the control piston may define a spring chamber housing a spring which applies a force to the valve carrier member.

In a preferred embodiment, the injector includes damping means to damp movement of the inner valve member as it is caused to move away from the second seating region in order to prevent oscillatory movement of the inner valve member. Preferably, the damping means includes a restricted passage provided in the control piston fluidly connecting the spring chamber to the accumulator volume.

It is also preferred that the injector includes restricted flow means for equalising pressure between the control chamber and the accumulator volume. The restricted flow means provides a safety feature since, in the event of actuator failure, fuel at rail pressure may flow into, or out of, the control chamber at a restricted rate to ensure that the inner and outer valve members are made to engage their respective seating regions.

Preferably, the restricted flow means is a restricted flow passage provided in the control piston.

In a further preferred embodiment, the outer valve member is provided with an upper seating line and a lower seating line engageable with the first seating region at respective positions either side of the first set of one or more outlets. It is preferred that the first and second seating lines are defined by upper and lower edges, respectively, of an annular groove provided on the outer valve needle.

Preferably, the nozzle body bore defines a first (upper) delivery chamber and a second (lower) delivery chamber for delivering fuel to the first and second set of outlets.

Preferably, cooperation between the first seating line and the first seating region controls fuel flow between the first delivery chamber and the first set of outlets and cooperation between the second seating line and the first seating region controls fuel flow between a second delivery chamber and the first set of outlets. In addition, the inner valve member may include at least one seating line to control delivery of fuel between the second delivery chamber and the second set of outlets.

Preferably, the first delivery chamber is arranged to communicate with the second delivery chamber via a communication flow path, which may be defined, at least in part, by a region of the bore of the outer valve member. Alternatively, the communication flow path may be defined, at least in part, by flow passages provided within the inner valve member.

According to a second aspect of the invention, the fuel injector has an injection nozzle comprising a nozzle body having a nozzle bore, an outer valve received within the nozzle bore and engageable with a first seating to control fuel delivery through a first set of one or more nozzle outlets, the outer valve being provided with an outer valve bore, an inner valve received within the outer valve bore and engageable with a second seating to control fuel delivery through a second set of one or more nozzle outlets. The injector includes an injection control chamber for fuel and a piezoelectric actuator for controlling the pressure of fuel within the injection control chamber, a first surface of the inner valve being exposed to fuel pressure within the injection control chamber, and a second surface of the outer valve being exposed to fuel pressure within the injection control chamber. The first and second surfaces are arranged such that when the pressure of fuel within the injection control chamber is increased from an intermediate fuel pressure to a relatively high pressure, one of the outer valve or the inner valve is caused to disengage its respective seating and when the pressure of fuel with the injection control chamber is reduced from the intermediate fuel pressure to a relatively low pressure, the other of the outer valve or the inner valve is caused to disengage its respective seating.

According to a third aspect of the invention, the fuel injector comprises an injection nozzle body being provided with a nozzle bore, an outer valve received within the nozzle bore for controlling fuel delivery through a first set of one or more nozzle outlets and an inner valve received within an outer valve bore provided in the outer valve for controlling fuel delivery through a second set of one or more nozzle outlets,. The injector includes an injection control chamber for fuel and a piezoelectric stack for controlling the pressure of fuel within the injection control chamber. A first surface associated with the inner valve is exposed to fuel pressure within the injection control chamber and a second surface associated with the outer valve is exposed to fuel pressure within the injection control chamber. When the control chamber is at an intermediate fuel pressure, there is no injection through the first or second set of outlets. The first and second surfaces are being arranged such that when the pressure of fuel within the injection control chamber is increased from the intermediate fuel pressure to a relatively high pressure, the inner valve is moved to allow injection through the second set of one or more nozzle outlets and when the pressure of fuel with the injection control chamber is reduced from the intermediate fuel pressure to a relatively low pressure, the outer valve is moved to allow injection through the first set of one or more nozzle outlets. The injector further comprises a coupler to couple movement of the outer valve to the inner valve when the outer valve is caused to move.

Preferred and/or optional features of the first aspect of the invention may be incorporated alone or in appropriate combination within the second and third aspects of the invention also.

By way of example, the invention will now be described with reference to the accompanying drawings, in which:

FIGS. 1A and 1B, respectively, show fuel delivery characteristics of "boot-shaped" and "square-shaped" form;

Figure 1A:
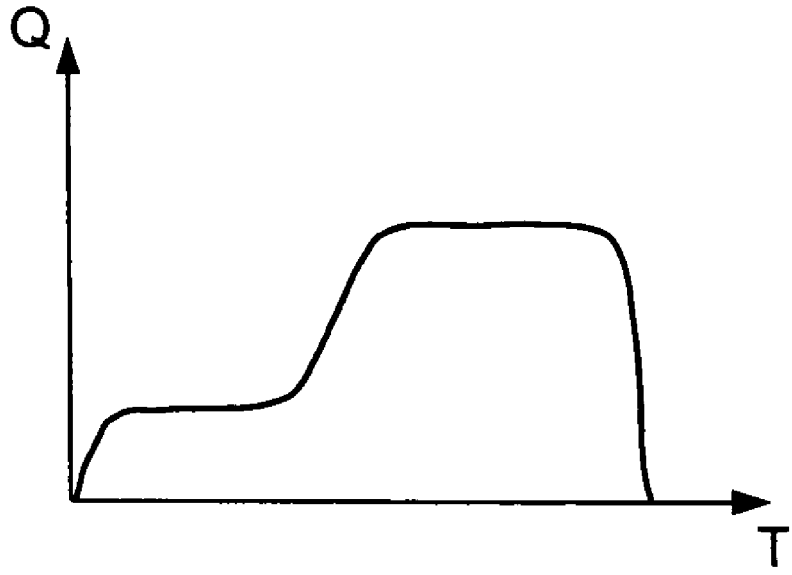
Figure 1B:
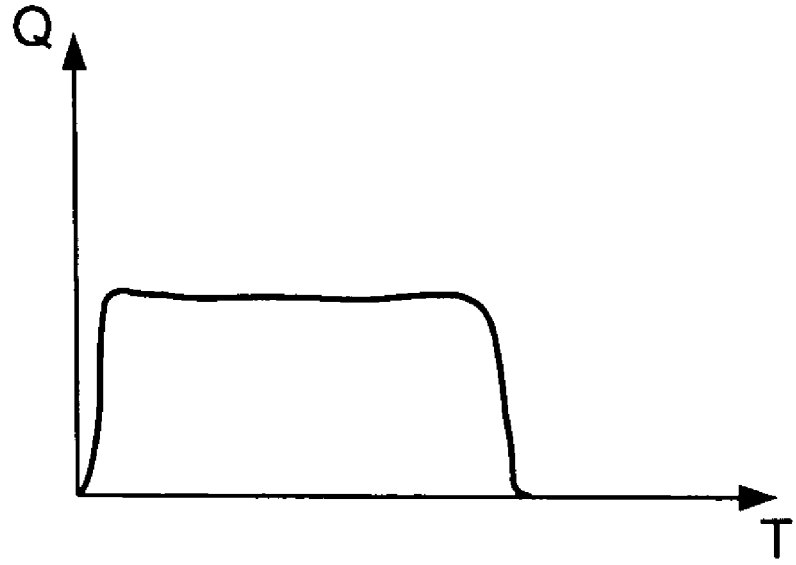

In the following description, the terms "upper" and "lower" are used having regard to the orientation of the injection nozzle as shown in the drawings. However, this terminology is not intended to limit the injection nozzle to a particular orientation. Likewise, the terms "upstream" and "downstream" are used with respect to the direction of fuel flowing through the nozzle from a fuel inlet to fuel outlets.

Figure 2:
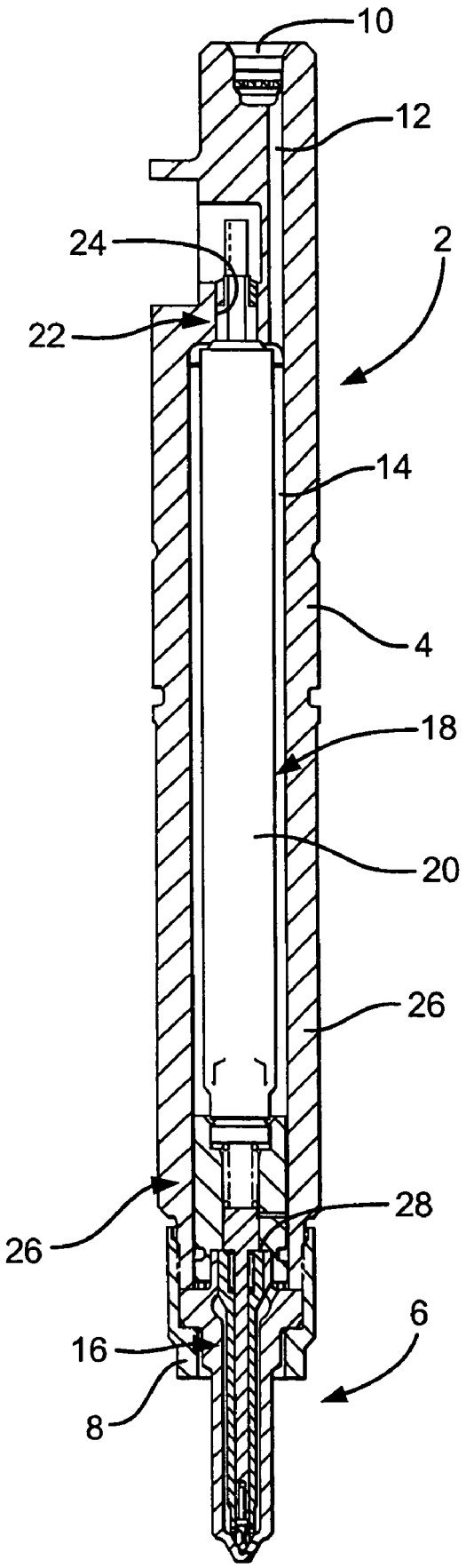
FIG. 2 is a sectional view of a fuel injector incorporating an injection nozzle in accordance with an embodiment of the present invention.

Referring to FIG. 2, there is shown a piezoelectric fuel injector, referred to generally as 2, which includes an injector body 4 and an injector nozzle, referred to generally as 6, which is secured to an end of the injector body 4 by means of a cap nut 8.

Fuel is supplied to the injector 2 via an injector inlet 10 from, for example, a common rail or other appropriate source of pressurised fuel, which is also arranged to supply fuel to one or more other injectors. The injector inlet 10 is located at an end of the injector 2 distal from the injector nozzle 6. Pressurised fuel is communicated from the inlet 10, through an inlet passage in the form of a drilling 12 and a cylindrical accumulator volume 14, both of which are provided in the injector body 4, to a needle valve arrangement 16 provided in the injector nozzle 6.

The accumulator volume 14 houses a piezoelectric actuator 18, which is operable to control the delivery of fuel from the injector 2. The piezoelectric actuator 18 comprises a stack 20 of piezoelectric elements arranged within the accumulator volume 14, and an electrical connector 22 extending through an upper opening 24 in the injector body 4 to enable the stack 20 to be connected to an external power supply (not shown). In use, the accumulator volume 14 is filled with high pressure fuel so as to apply a hydrostatic loading to the stack 20.

The piezoelectric actuator 18 is coupled to the valve arrangement 16 by way of a load transmission means 26 arranged within a lower region of the accumulator volume 14. Varying the voltage applied to the stack 20 causes the stack 20 to extend and contract thus controlling the axial position of the load transmission means 26. In turn, the axial position of the load transmission means 26 controls the volume of, and thus the pressure of fuel within, a valve control chamber 28, the load transmission means and the piezoelectric actuator together constituting a pressure control means.

Figure 3A:
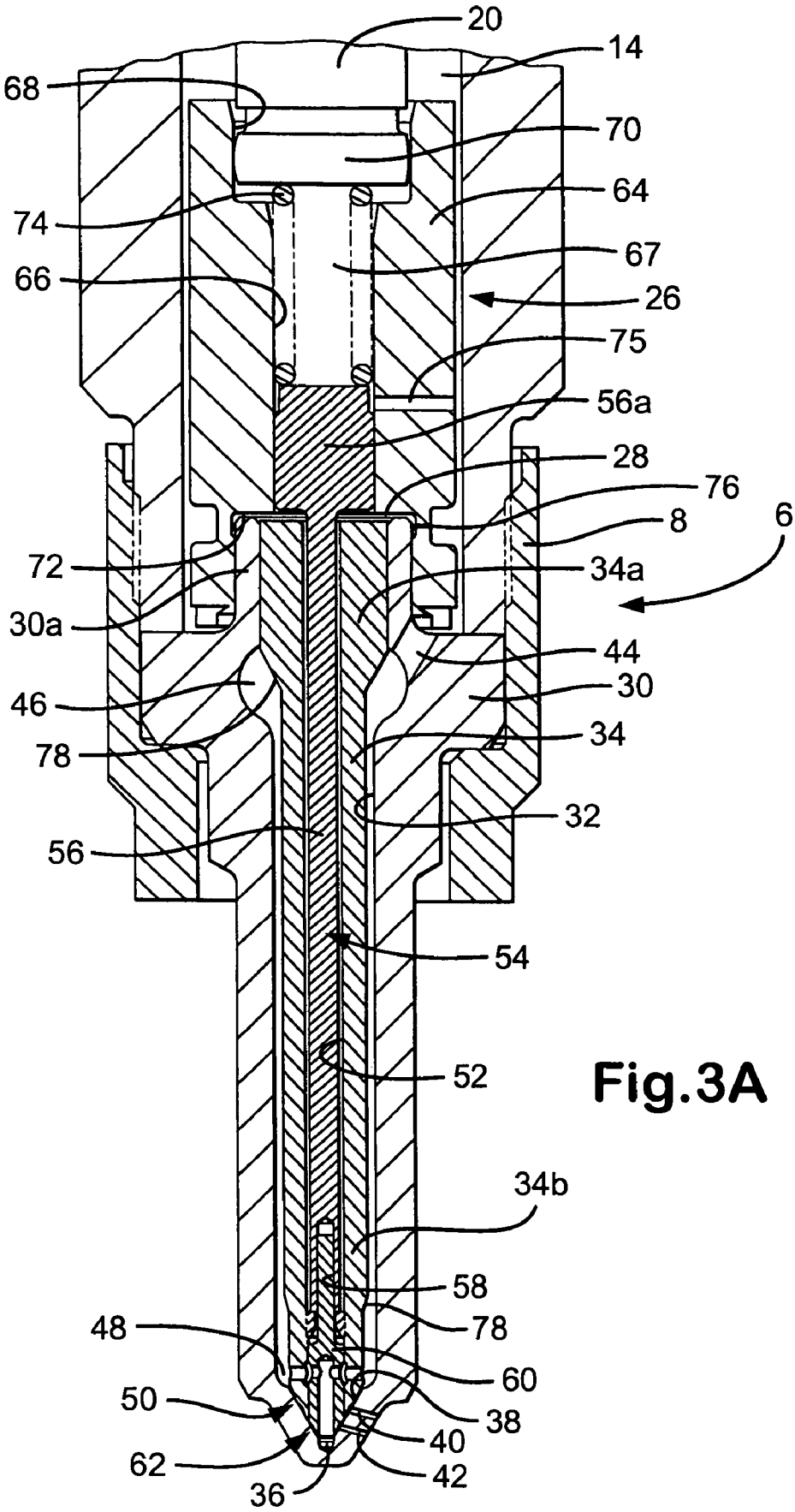
FIG. 3A is an enlarged sectional view of the injection nozzle in FIG. 2 when in a non-injecting position.

Referring now to FIG. 3A, which shows the injector nozzle 6 and the load transmission means 26 in more detail, the injector nozzle 6 includes a nozzle body 30 provided with a blind axial bore 32 within which a first (outer) valve member 34 in the form of a needle is slidably received. The bore 32 terminates in a sac volume 36 and, at its blind end, defines a seating surface 38 of conical form.

The nozzle body 30 is provided with a first and a second set of outlets 40, 42 through which pressurised fuel is delivered into an associated combustion space, in use. The inlet ends of the first and second set of outlets 40, 42 extend radially away from the seating surface 38 such that their outlet ends open at the outer surface of the nozzle body 30. The first set of outlets 40 are of relatively large diameter providing a relatively large flow area for fuel to be injected into the engine and the second set of outlets 42 are of a smaller diameter providing a lesser flow area for fuel. It will be appreciated, however, that the first set of outlets 40 alternatively may be formed so as to provide a lower flow area for fuel relative to the second set of outlets 42. It will also be appreciated that only a single outlet of each of the first and second sets of outlets 40, 42 is shown in the figures with the outlet of each set being disposed at a different axial position along the main axis of the nozzle body 30. However, in practice, each set of outlets may include a plurality of outlets.

It should be mentioned at this point that although contemporary nozzle designs generally include two or more nozzle outlets in a set, the term "set" applies also to a single outlet. Therefore, in the foregoing description, a reference to the term "outlets" is to be construed as meaning one or more outlets.

Pressurised fuel is received by the nozzle body 30 from the accumulator volume 14 through a nozzle inlet passage 44 and is supplied into an annular chamber 46 defined between the nozzle body bore 32 and an enlarged upper end region 34*a* of the outer valve member 34. The upper end region 34*a* has a diameter substantially equal to that of the nozzle body bore 32 such that cooperation between these parts serves to guide movement of the outer valve member 34 as it slides within the bore 32, in use. The upper face of the upper end region 34*a* lies substantially flush with an upwardly extending projection 30*a* defined by the nozzle body 30 in circumstances in which the outer valve member 34 is seated.

A lower end region 34*b* of the outer valve member 34 is slimmer than the nozzle body 32 so as to define a space therebetween so that fuel can travel from the annular chamber 46 to a first delivery chamber 48. The first delivery chamber 48 is located in the vicinity of the blind end of the nozzle body bore 32 and is defined between the outer surface of the outer valve member 34 and a region of the nozzle body bore 32 upstream of the first and second sets of outlets 40, 42. The outer valve member 34 is engageable with a valve seating region 50 defined by the seating surface 38 to control delivery of fuel through the first set of outlets 40.

The outer valve member 34 itself is provided with an axial through bore 52 arranged to receive an inner valve assembly 54 therethrough. The inner valve assembly 54 includes a valve carrier member 56 having an upper end that protrudes from the outer valve bore 52 and terminates in a cylindrical head portion 56*a* of piston-like form having a diameter greater than that of the outer valve bore 52. The underside face of the head portion 56*a* opposes the upper end face of the outer valve member 34 and together they define, in part, the control chamber 28. The end of the carrier member 56 distal from the head portion 56*a* is provided with a drilling defining a blind bore 58 within which a needle-like inner valve member 60 is securely received. The inner valve member 60 is engageable with a valve seating region 62 defined by the seating surface 38 to control delivery of fuel through the second set of outlets 42.

The load transmission means 26 includes a piston member 64 located within the accumulator volume 14 and disposed intermediate the stack 20 and the nozzle body 30. The piston member 64 is of substantially cylindrical form and has a diameter less than that of the accumulator volume 14 to permit relative movement therewith. Pressurised fuel is thus permitted to flow past the outer surface of the piston member 64 to the nozzle inlet passage 44 provided in the nozzle body 30.

The piston member 64 is provided with a longitudinal bore 66, the upper end of which opens into a recess 68. The upper recess 68 receives securely an end piece 70 of the piezoelectric stack 20 such that axial movement of the end piece 70 due to extension and contraction of the stack 20 is transmitted to the piston member 64. The lower end of the piston member bore 66 opens into a second recess 72 provided in a second, lower end of the piston member 64. The lower recess 72 receives the projection 30*a* defined by the nozzle body 30 such that the piston member bore 66 receives the head portion 56*a* of the carrier member 56, which extends beyond the upper end of the outer valve member 34. The control chamber 28 is therefore defined by surfaces associated with the outer valve member 34, the inner valve assembly 54, the nozzle body 30 and the piston member 64.

By virtue of their opposed end faces being exposed to fuel pressure within the control chamber 28, fuel pressure therein acts on the outer valve member 34 and the carrier member 56 in relatively opposed axial directions.

A helical spring 74 is disposed within the piston member bore 66 intermediate the end piece 70 of the piezoelectric stack 20 and the head portion 56*a* of the carrier member 56 so as to bias the inner valve member 60 into engagement with its seating region 62. The bore 66 thus defines a spring chamber 67. The spring chamber 67 communicates with the accumulator volume 14 by way of an orifice 75 provided in the piston member 64. Fuel is thus permitted to flow through the orifice 75 in accordance with movement of the head portion 56*a*. Preferably the orifice may be restricted to damp the movement of the head portion 56*a*.

Figure 3B:
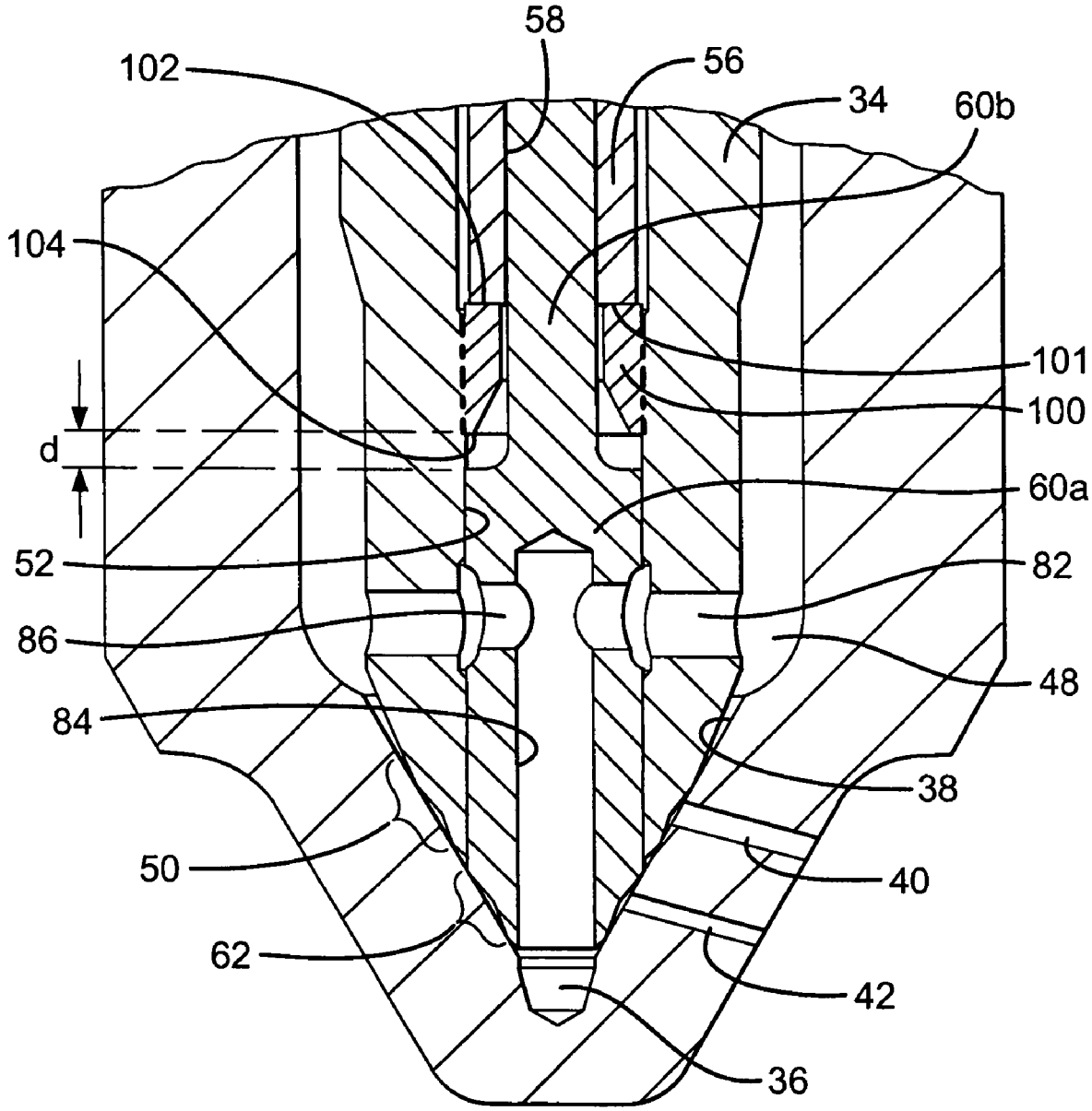
FIG. 3B is an enlarged sectional view of the injection nozzle in FIG. 3A.
Figure 3C:
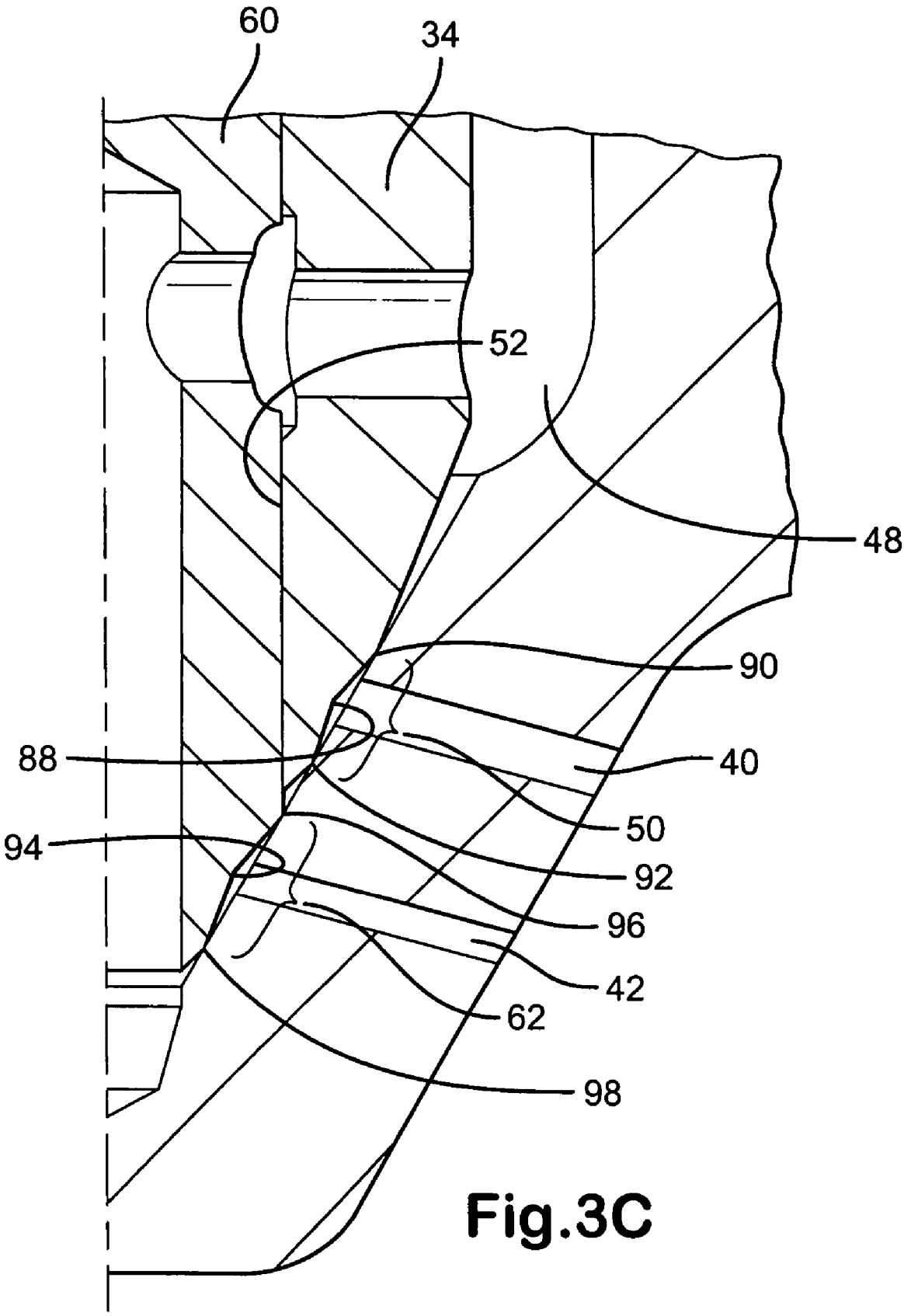
FIG. 3C is a further enlarged sectional view of the injection nozzle in FIGS. 3A and 3B.

When the piezoelectric stack 20 is at the energisation level as is shown in FIGS. 3A, 3B and 3C, the pressure of fuel within the control chamber 28 is substantially equal to the pressure of fuel within the accumulator volume 14 since the control chamber 28 communicates with the accumulator volume by way of a restricted orifice 76. For the purposes of this description, the energisation level of the piezoelectric stack 20 at this point will be referred to as an "intermediate energisation level" and the pressure of fuel within the control chamber 28 will be referred to as an "intermediate fuel pressure".

When the piezoelectric stack 20 is at the intermediate energisation level, fuel pressure within the control chamber 28 acting on the upper face of the enlarged end region 34*a* of the outer valve member 34 provides a force urging the outer valve member 34 into engagement with its seating region 50 that is greater than the opposing force acting on the outer valve member 34 by virtue of thrust surfaces 78 provided on its external surface. Conversely, fuel pressure in the control chamber 28 acting on the exposed surface of the head portion 56*a* of the carrier member 56 provides a force urging the inner valve member 60 to disengage its seat that is less than the opposing force provided by the spring 74 and the pressure in the spring chamber 67. Thus, the inner valve member 60 remains seated. As a result, when the pressure of fuel within the control chamber 28 is substantially equal to the pressure of fuel within the accumulator volume 14, fuel delivery does not take place through either of the first or the second sets of outlets 40, 42.

It will be appreciated that the restricted orifice 76 provides a safety function in the event of injector failure since it will enable the pressure of fuel within the control chamber 28 to equalise with the pressure of fuel in the accumulator volume 14, which ensures the injector 2 remains in a non-injecting state.

FIG. 3B shows the tip of the nozzle body in greater detail. The inner valve member 60 is of stepped form and includes an enlarged diameter portion 60*a* and a narrower neck portion 60*b*, the two portions being separated by an annular shoulder 80 defining an abutment surface. The neck portion 60*b* has a diameter substantially the same as that of the bore provided in the carrier member 56 such that it forms an interference fit therewith. Movement of the carrier member 56 is thus coupled directly to the inner valve member 60. The enlarged diameter region 60*a* is generally of cylindrical form and has a diameter slightly less than the bore 52 provided in the outer valve member 34 so as to define a sliding fit therewith. As a result, the enlarged diameter region 60*a* serves to guide movement of the inner valve member 60 as it is moved into and out of engagement with the inner valve seating region 62 to control fuel injection through the second set of outlets 42.

Towards its tip, the outer valve member 34 is provided with radial passages 82, by which means the bore 52 of the outer valve member 34 communicates with the first delivery chamber 48. Further, the enlarged diameter region 60*a* of the inner valve member 60 is provided with a flow passage in the form of an axially extending blind bore 84 which communicates with the outer valve member bore 52, and thus with the first delivery chamber 48, by way of radial drillings 86 provided in the inner valve member 60. In the embodiment shown, the radial drillings 82, 86 provided in both the inner and outer valve members 60, 34 are disposed in mutual axial alignment when both members 60, 34 are seated.

The bore 84 and the radial drillings 86 provided in the inner valve member 60, together with the radial drillings 82 provided in the outer valve member 34, together define a communication path along which fuel can flow from the first delivery chamber 48 to the sac volume 36, which thus constitutes a second delivery chamber.

In this embodiment, both the inner and outer valve members 60, 34 are provided with first and second seats that engage their respective seating regions 62, 50 of the seating surface 38 at seating lines axially above and below the first and second sets of outlets 40, 42, respectively. Referring to FIG. 3C, which shows part of the tip of the injector nozzle in greater detail, the outer valve member 34 is shaped to define a grooved or recessed region 88 which defines, at respective upper and lower edges thereof, an upper seating line 90 and a lower seating line 92 which engage the seating region 50 of the seating surface 38 axially above and below the first set of outlets 40, respectively, when the outer valve member 34 is seated. Therefore, cooperation between the first seating line 90 and the seating region 50 controls fuel flow between the first delivery chamber 48 and the first set of outlets 40 and cooperation between the second seating line 92 and the seating region 50 controls fuel flow between the second delivery chamber 36 and the first set of outlets 40, particularly in circumstances when the inner valve needle 60 if lifted from its seating 62.

In a manner similar to that of the outer valve member 34, the lower region of the inner valve member 60 is provided with a grooved or recessed region 94 which defines, at respective upper and lower edges thereof, upper and lower seating lines 96, 98 that are arranged to engage the lower seating region 62 axially above and below the second set of outlets 42, respectively, when the inner valve member 60 is seated. Put another way, the second set of outlets 42 are arranged intermediate the positions at which the seating lines 96, 98 engage the seating region 62.

Referring once again to FIG. 3B, an annular stop member 100 in the form of a ring is received within the bore 52 of the outer valve member 34 and receives the neck portion 60*b* of the inner valve member 60 therethrough. The stop member 100 is a separate and distinct part and is coupled to the outer valve member 34 through frictional contact between the outer surface of the stop member 100 and the internal surface of the bore 52. The stop member 100 includes a first, upper end face 102 and a second, lower end face 104 and is arranged in the bore 32 during manufacture such that the upper end face 102 abuts a cooperating surface 101 of the inner valve carrier 56 when the outer valve member 34 and the inner valve member 60 are seated. The lower end face 104 of the stop member 100 is spaced from the shoulder 80 of the inner valve member 60 by a distance 'd' that is predetermined at manufacture.

When the outer valve member 34 is caused to lift from its seating region 50, in use, the stop member 100 is in engagement with the inner valve carrier 56 and so the inner valve member 60 is also caused to lift from its seating region 62 by a corresponding amount. Alternatively, when the inner valve member 60 is lifted out of engagement with its seating region 62, in use, it may move axially by an amount equal to the predetermined distance 'd' at which point the shoulder 80 engages the stop member 100. The force urging the outer valve member 34 into engagement with its seating region 50 is greater than the opposing force lifting the inner valve member 60 so that the stop member 100 serves to limit movement of the inner valve member 60 beyond the predetermined distance 'd'. It should be appreciated that the lower end face 104 of the stop member 100 and the abutment shoulder 80 of the inner valve member 60 are at maximum separation (i.e. predetermined distance 'd') when both the inner and the outer valve members 60, 34 are seated.

Operation of the injector will now be described. Initially, the injector 2 is in a non-injecting state as shown in FIGS. 3A, 3B and 3C and the pressure of fuel within the control chamber 28 is at an intermediate level. At this point, the force due to fuel pressure acting on thrust surfaces 78 of the outer valve member 34 is insufficient to overcome the opposing force due to fuel pressure within the control chamber 28 acting on the upper end face of the outer valve member 34. Similarly, fuel pressure within the control chamber 28 does not exert sufficient force on the head portion 56*a* of the carrier member 56 to overcome the opposing force provided by the spring 74 and the pressure of fuel within the spring chamber 67. As a result, injection does not take place.

Figure 4A:
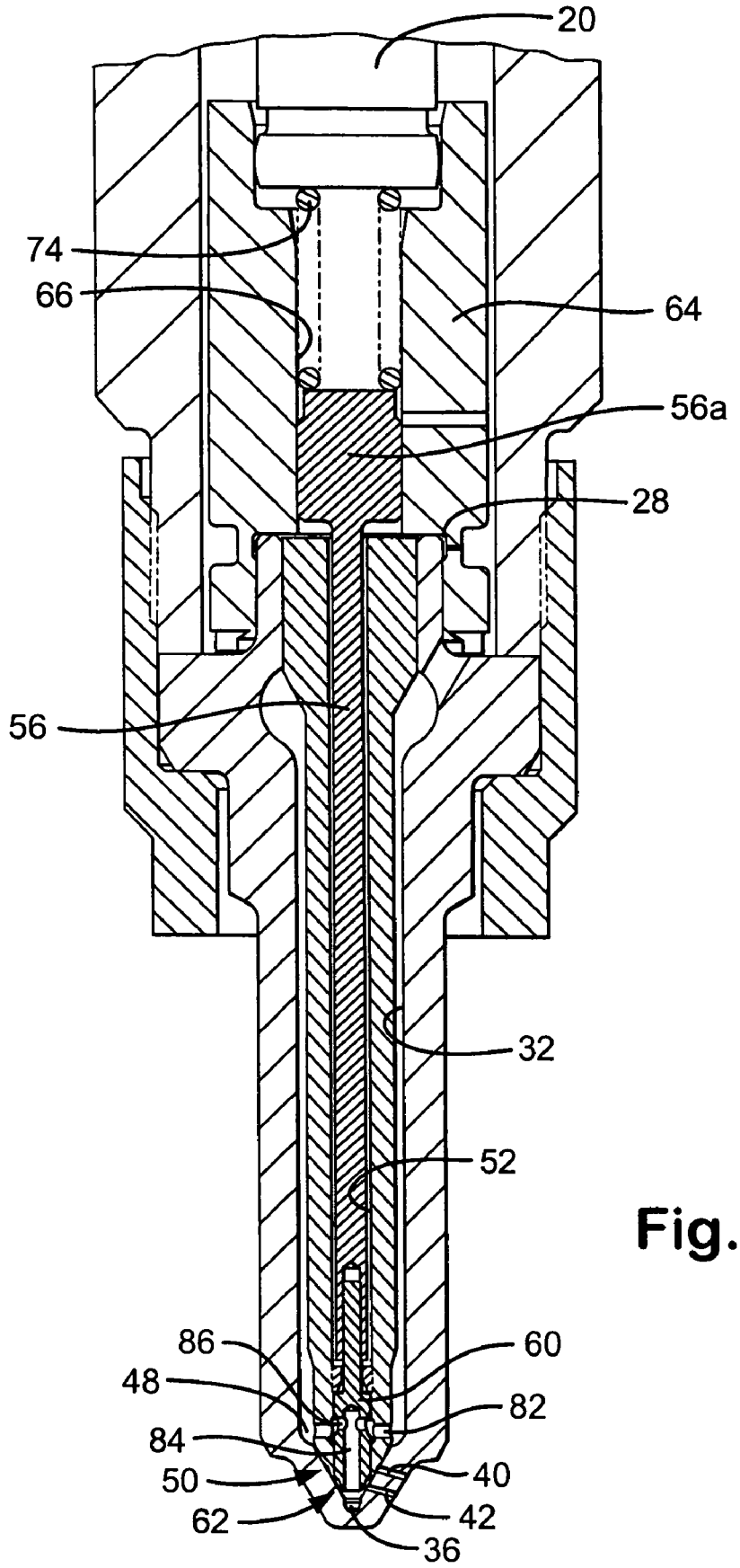
FIG. 4A is a sectional view of the injection nozzle in FIGS. 2, 3A, 3B and 3C when in a first injecting position.
Figure 4B:
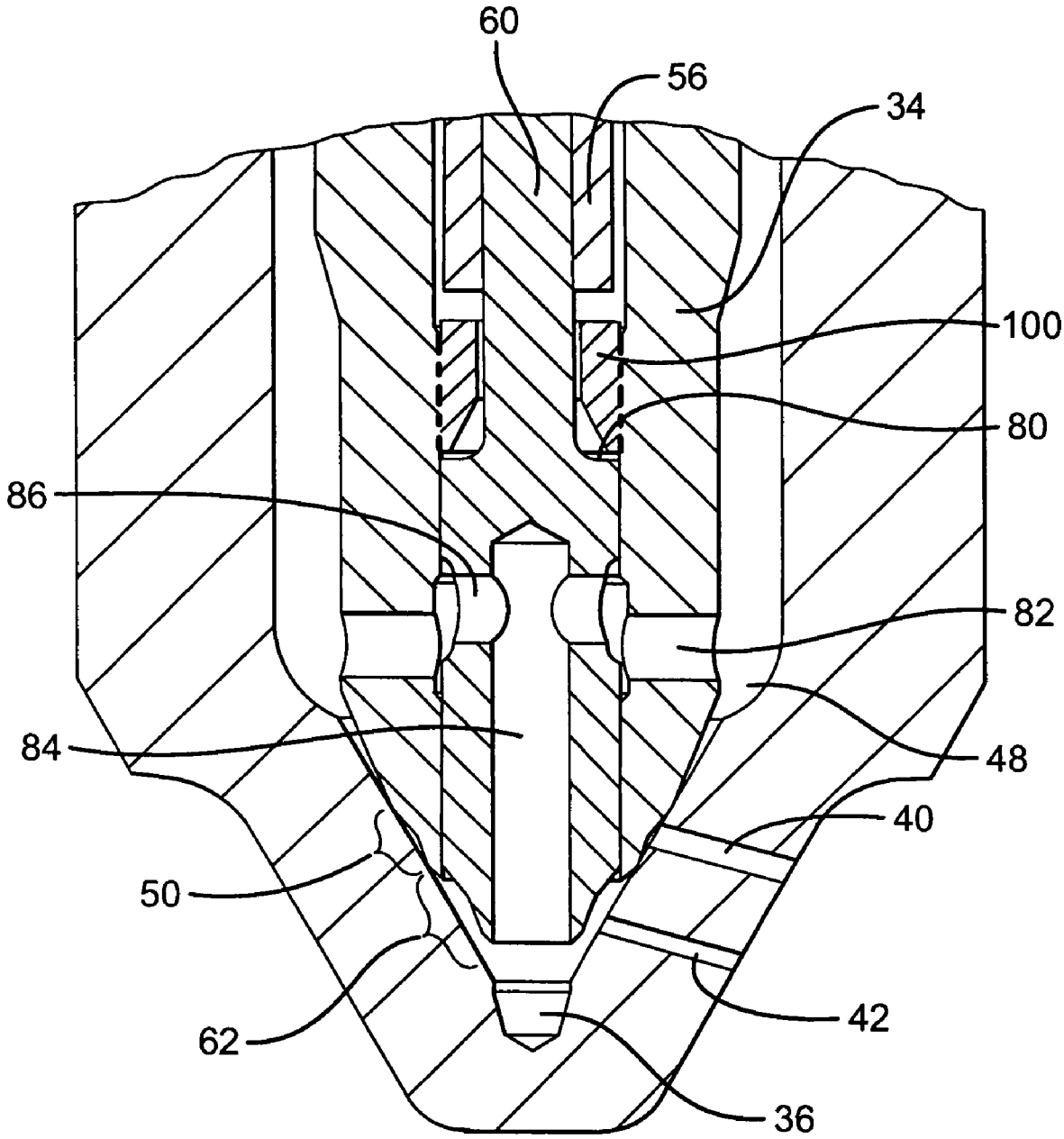
FIG. 4B is an enlarged sectional view of the injection nozzle in FIG. 4A.

In order to cause injection to occur through the second set of outlets 42 only, the stack 20 is energised (extended) which causes the control piston 64 to move in a downward direction as illustrated in FIGS. 4A and 4B. Downward movement of the piston member 64 decreases the volume of the control chamber 28 and, as a result, raises the pressure of fuel therein to a relatively high level such that the head portion 56*a* of the carrier member 56 is urged axially upward within the bore 66 of the piston member 64 against the opposing force of the spring 74. The inner valve member 60 thus disengages its seating region 62 permitting fuel to flow from the first delivery chamber 48 to the second delivery chamber 36 though the communication path 82, 84, 86. From the second delivery chamber 36, fuel flows past the lower seating line 98 of the inner valve member 60 and through the second set of outlets 42 into an associated combustion chamber (not shown).

The inner valve member 60 may continue to move away from its seating region 62 until it has moved through a distance equal to the distance 'd' such that the shoulder 80 engages the lower end face 104 of the stop member 100. The outer valve member 34 is held in engagement with its seating region 50 due to the pressure of fuel within the control chamber 28 exerting a downward force that is greater than the upward force exerted by the inner valve member 60. Thus, further movement of the inner valve member 60 is prevented.

To terminate injection through the second set of outlets 42, the stack 20 is de-energised (returned to the intermediate level) causing upward movement of the piston member 64 and thus increasing the volume of the control chamber 28 such that the pressure of fuel therein returns to the intermediate level. As a result, the upward force on the head portion 56*a* of the carrier member 56 is reduced and the inner valve member 60 is urged to re-engage its seating region under the influence of the spring 74 and fuel pressure within the spring chamber 67, so terminating fuel delivery through the second set of outlets 42.

The above injection state results in a relatively low volume of fuel delivery having a flow rate characteristic of approximately square form being particularly suited to periods of low engine load.

In addition to providing the ability to inject a relatively small amount of fuel having a square-shaped delivery characteristic during low engine load conditions, the invention provides the flexibility to deliver a greater amount of fuel if necessary, for example, during relatively high engine load conditions, as will now be described.

Figure 5A:
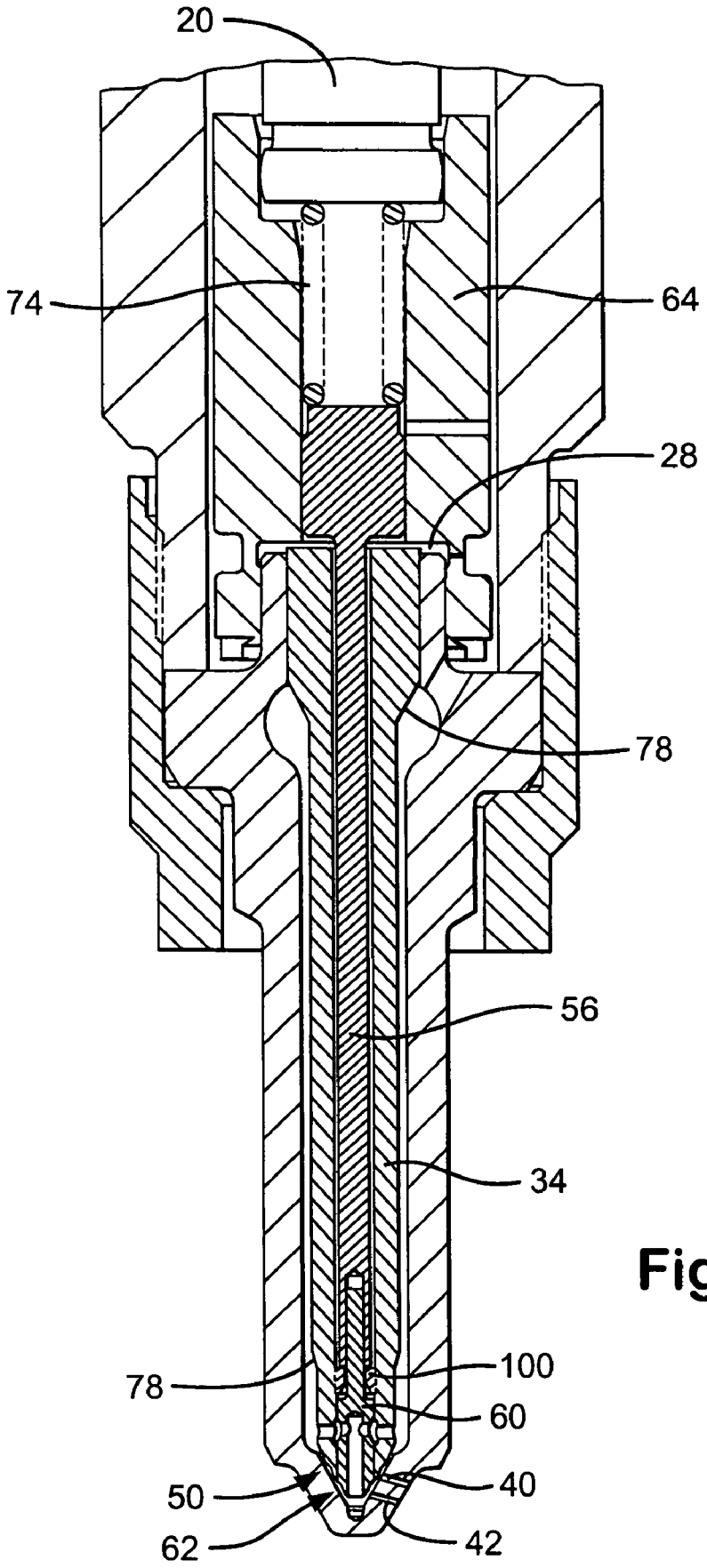
FIG. 5A is a sectional view of the injection nozzle in FIGS. 2, 3A, 3B, 3C, 4A and 4B when in a second injecting position.
Figure 5B:
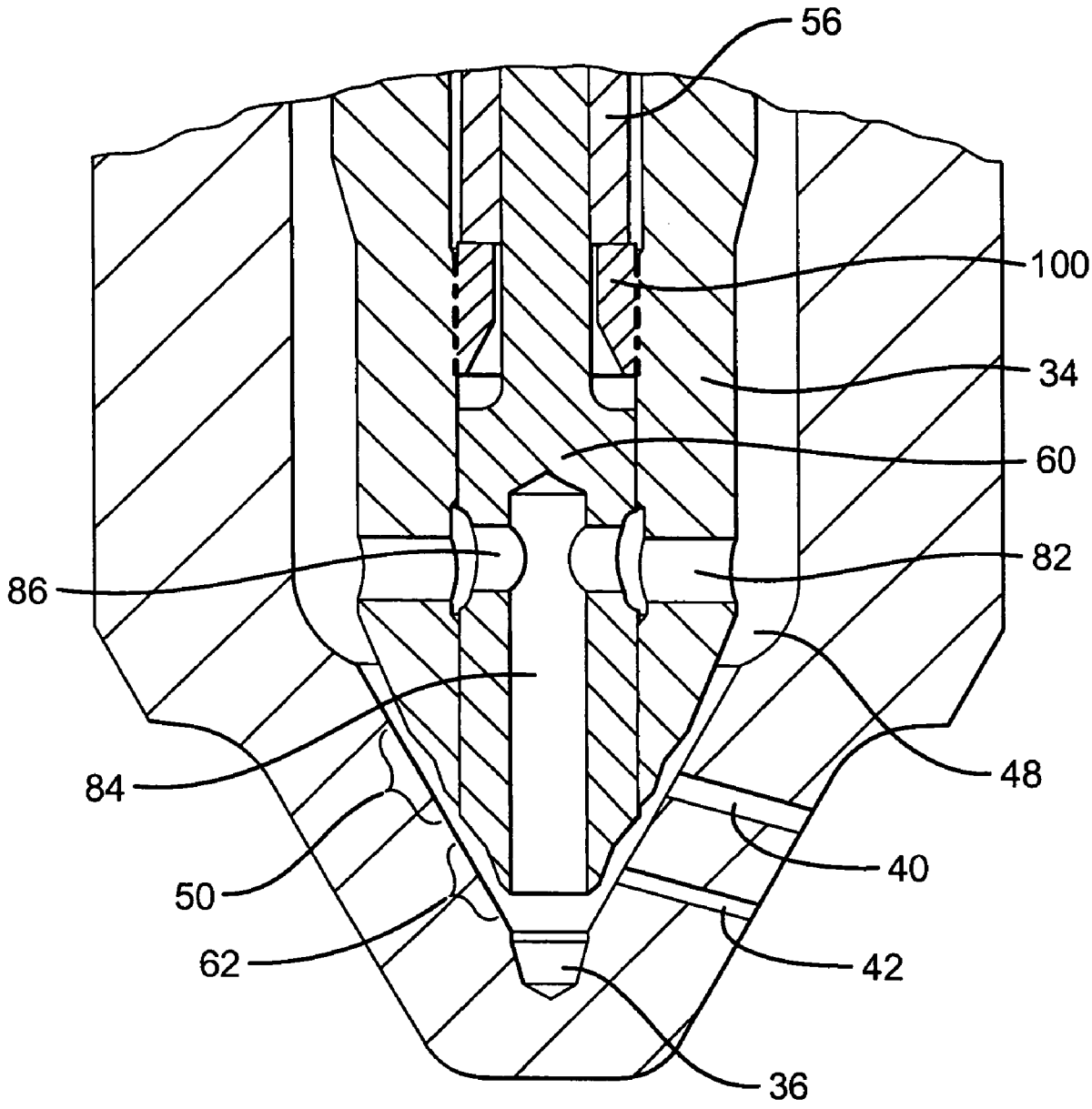
FIG. 5B is an enlarged sectional view of the injection nozzle in FIG. 5A.

In order to cause injection through both the first and the second set of outlets 40, 42 simultaneously, the stack 20 is de-energised (contracted) which causes the piston member 64 to move in an axially upward direction as illustrated by FIGS. 5A and 5B. The upward movement of the piston member 64 increases the volume of the control chamber 28 and so reduces the pressure of fuel therein to a relatively low level. As a result, the net force acting on the outer valve member 34 urging it into engagement with its seating region 50 reduces to an amount less than the force due to fuel pressure acting on the thrust surfaces 78, thus causing the outer valve member 34 to disengage its seating region 50. As the stop member 100 is engaged with the inner valve carrier 56 when both the outer and inner valve members 34, 60 are seated, upward movement of the outer valve member 34 also causes the inner valve member 60 to lift from its seating region 62 simultaneously such that fuel is permitted to flow through both the first and second sets of outlets 40, 42. It should be appreciated that the force exerted on the outer valve member 34 due to fuel pressure acting on the thrust surfaces 78 is also greater than the opposing force of the spring 74 and fuel pressure within the spring chamber 67 acting on the head portion 56*a* of the carrier member 56.

By virtue of the first and second seating lines 90, 92, 96, 98 provided on each of the outer and inner valve members 34, 60, together with the communication path 82, 84, 86 between the first and second delivery chambers 48, 36, fuel is permitted to flow to the first set of outlets 40 from both upstream and downstream directions. Firstly, fuel can flow from the first delivery chamber 48, past the upper seating line 90 provided on the outer valve member 34, to the outlets 40. In addition, fuel can flow from the first delivery chamber 48 to the second deliver chamber 36 through the communication path 82, 84, 86 and from the second delivery chamber 36, past the second seating line 92 to the outlets 40.

Figure 6:
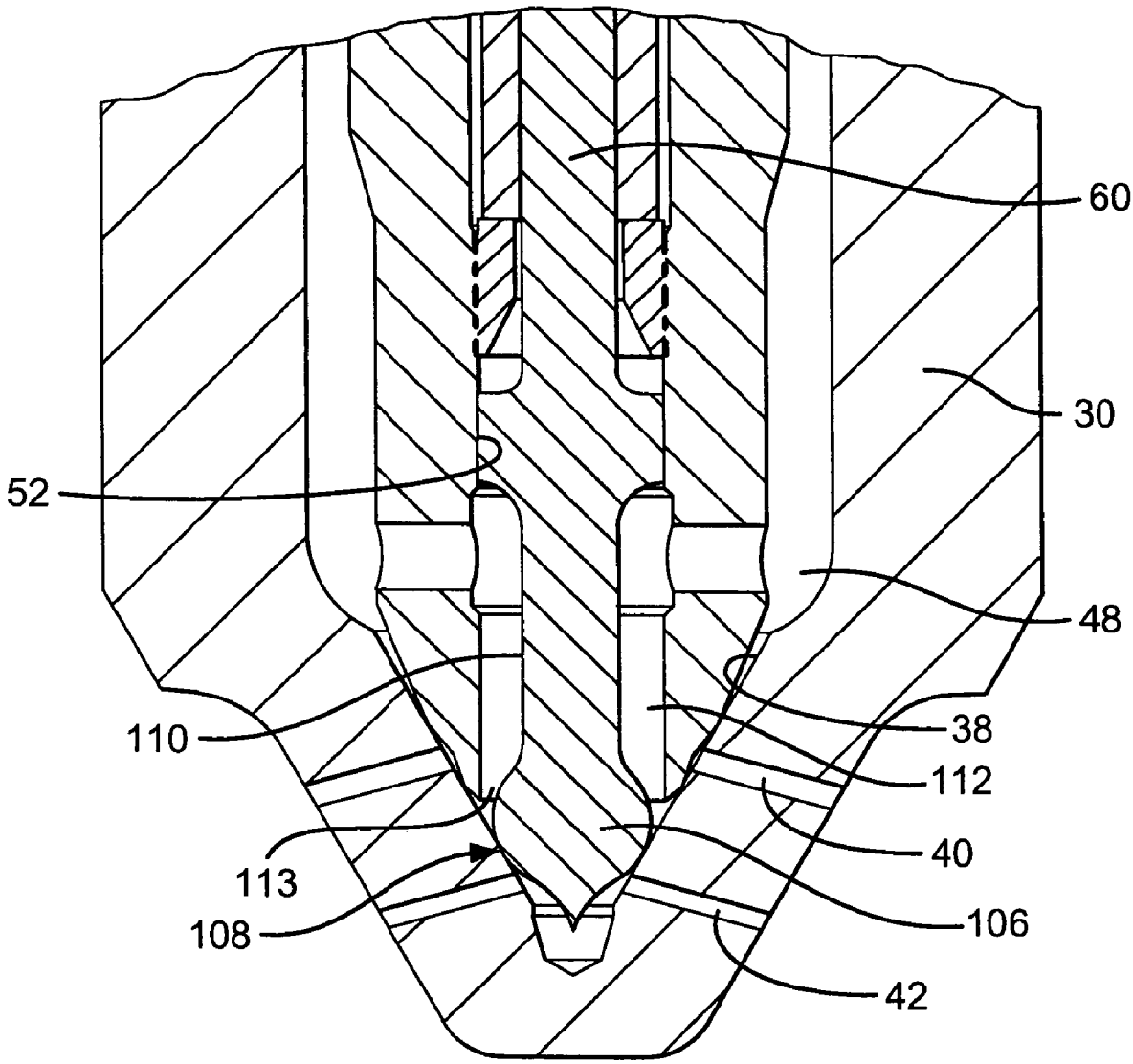
FIG. 6 is an enlarged sectional view of an injection nozzle in accordance with an alternative embodiment of the invention.

Although in the above embodiment both the inner and outer valve members 60, 34 are described as having twin seating lines, it should be appreciated that the inner and outer valve members 60, 34 may be provided with alternative seat arrangements. For example, in an alternative embodiment, as shown in FIG. 6, the inner valve member 60 may be provided with a part spherical tip 106 which defines a single seat 108 for engagement with the seating surface 38. It will be appreciated that the second set of outlets 42 are disposed in an axially lower position in this embodiment. At a region axially above the spherical tip 106, the inner valve member 60 is provided with a reduced diameter region 110 such that a fuel flow passage 112 of annular form is defined between the outer surface of the inner valve member 60 and the bore 32 of the outer valve member 34. Thus, a second delivery chamber 113 is defined between the lower seating line 92 of the outer valve member 34 and the seat 108 of the inner valve member 60.

Although the invention as described is most appropriate for supplying a "square-shaped" injection characteristic at both low load and full load engine conditions, by lifting solely the inner valve member 60 or, alternatively, both the inner and outer valve members 60, 34 simultaneously, it is also possible to operate the injection nozzle of the invention so as to obtain an approximated "boot-shaped" injection characteristic if desired.

To achieve a boot-shaped injection characteristic, initially the stack 20 is energised (extended) to increase the fuel pressure in the control chamber 28 to a relatively high level such that the inner valve member 60 is caused to disengage its seating region 62, as has been described. Thus, a relatively low rate of fuel delivery will occur. Shortly after the stack 20 has been extended, the stack 20 is de-energised rapidly to cause a corresponding rapid contraction of the stack 20, drawing the piston member 64 in an upward direction such that fuel pressure within the control chamber 28 is reduced. As a result, the inner valve member 34 will be urged to re-engage it seating region 62 and the outer valve member 34 will be caused to disengage its seating region 50 almost concurrently. Fuel will therefore be delivered through both the first and second sets of outlets 40, 42. To terminate injection, the energisation level of the stack 20 is returned to the intermediate level to ensure that both the inner and outer valve members 60, 34 are re-seated.

In practice, it is likely that a small delay may occur between the inner valve member 60 re-engaging its seating region 62 and the outer valve needle 34 disengaging its seating region 50. However, if the pressure change within the control chamber 28 and corresponding movement of the inner and outer valve members 60, 34 are sufficiently rapid, the detrimental effects on engine power output and exhaust emissions are negligible or, at least, limited to acceptable levels.

Figure 7A:
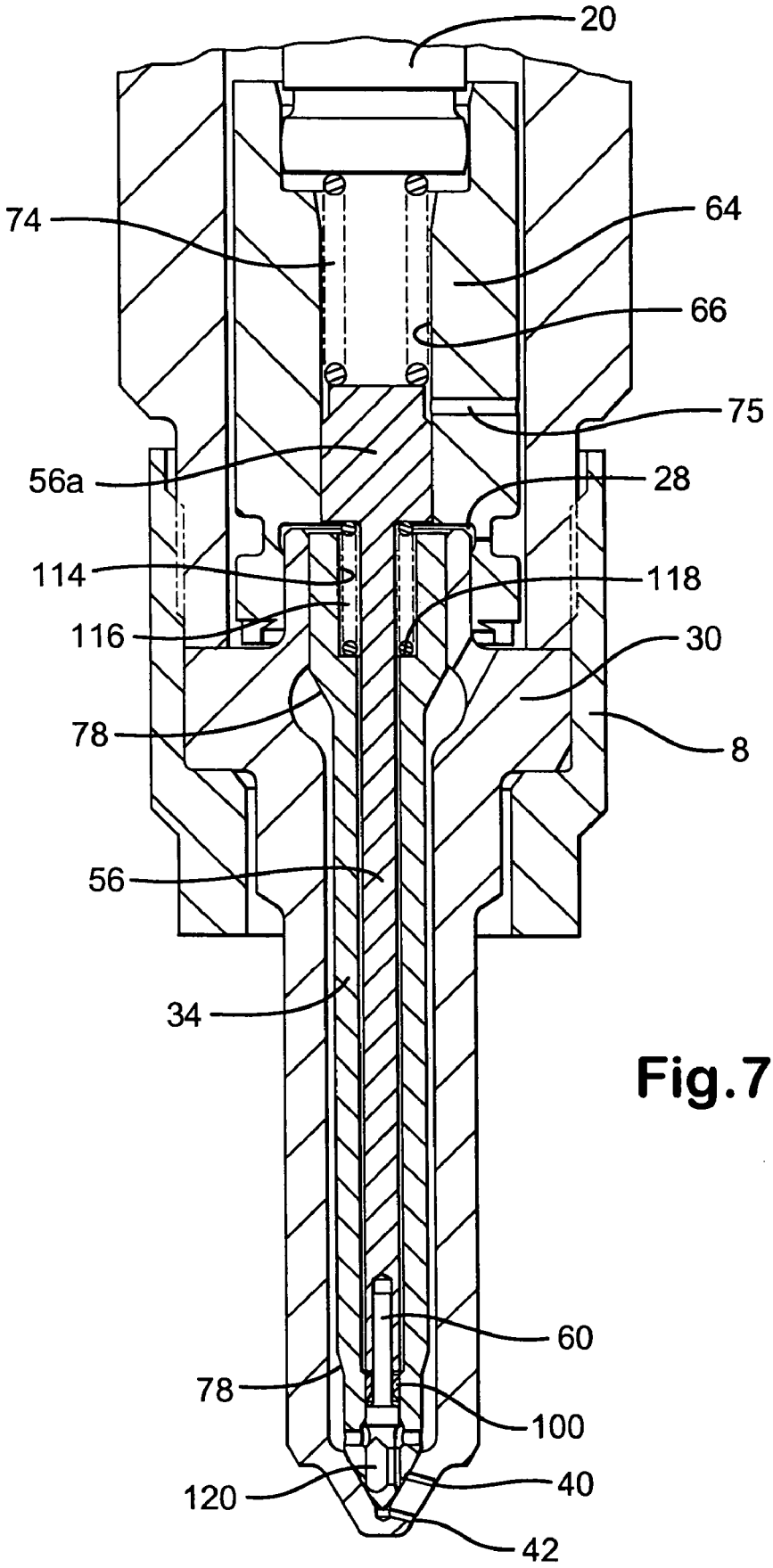
FIG. 7A is a sectional view of an injection nozzle in accordance with another embodiment of the invention.
Figure 7B:
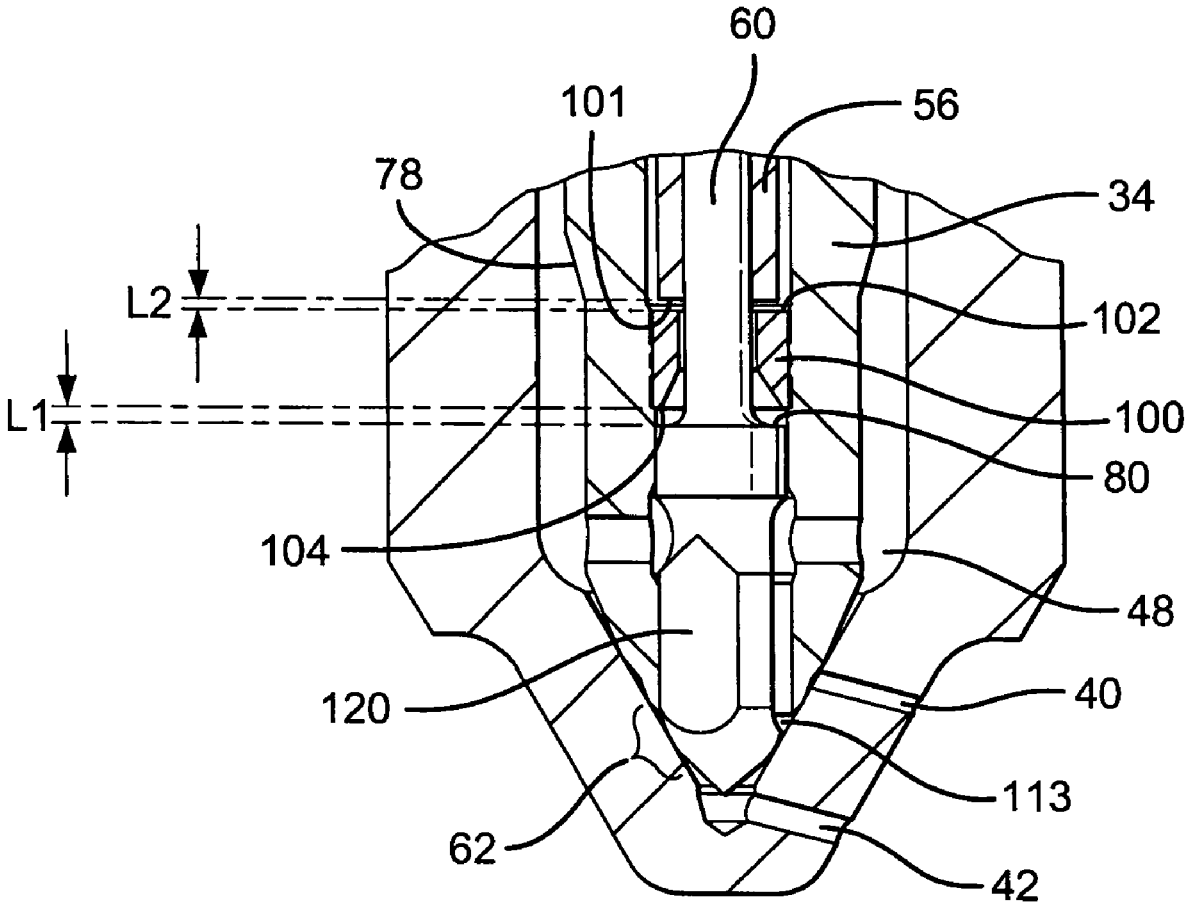
FIG. 7B is an enlarged sectional view of the injection nozzle of FIG. 7A.

Reference shall now be made to a further alternative embodiment, as shown in FIGS. 7A and 7B, which differs from those embodiments previously described as follows.

The stop member 100 is positioned within the bore 52 such that a first clearance having a length L1 is defined between the lower end face 104 of the stop member 100 and the shoulder 80 of the inner valve member 60. A second clearance having a length L2 is defined between the upper end face 102 of the stop member 100 and the cooperating surface 101 of the carrier member 56 when both the inner valve member 60 and the outer valve member 34 are engaged with their respective seating regions 50, 62. Put another way, the stop member 100 is arranged in a slightly lower axial position within the bore 52 of the outer valve member 34 relative to the position of the stop member in previous embodiments. Positioning of the stop member 100 in this manner enables the fuel delivery characteristic to be determined at manufacture in order to suit a particular engine application.

To inject through the lower set of outlets 42 only, the stack 20 is energised (extended) to raise the pressure within the control chamber 28 and therefore cause the inner valve member 60 to disengage its seating region 62. Once the inner valve member 60 has moved through a distance equal to the clearance L1, the shoulder 80 abuts the lower surface 104 of the stop member 100 preventing further movement of the inner valve member 60 away from its seating region 62. The stop member 100, and hence the outer valve member 34, cannot be lifted at this time as fuel pressure in the control chamber 28 is high.

Injection of fuel through the lower outlets 42 is terminated by de-energising (retracting) the stack 20 such that pressure of fuel within the control chamber 28 returns to the intermediate level. As a result, the inner valve member 60 re-engages with its seating region 62 under the influence of the spring 74 and fuel pressure within the spring chamber 67. Since pressurised fuel is delivered only through the lower outlets 42, the volume of fuel delivered is relatively low.

If it is required to deliver a greater volume of fuel, the stack 20 is de-energised (retracted) drawing the piston member 64 in an upwards direction which reduces the pressure of fuel within the control chamber 28 to a relatively low level. As a result, the force due to fuel pressure acting on the thrust surfaces 78 of the outer valve member 34 is greater than the force due to fuel pressure within the control chamber 28 acting on the upper face of the outer valve needle 34, therefore causing the outer valve member 34 to disengage its seating region 50. Pressurised fuel is therefore injected through the upper set of outlets 40 only. The inner valve member 60 is maintained in engagement with its seating region 62 due to the force of the spring 74 acting on the head 56*a* and due to the high pressure of fuel within the spring chamber 67 in comparison with the de-pressurised control chamber 28.

Further de-energisation of the stack 20 causes further depressurisation of fuel within the control chamber 28 so that the outer valve member 34 is lifted through a distance greater than L2. Movement of the outer valve member 34 beyond the distance L2 causes the inner valve needle 60 to be lifted away from its seating region 62 also and, therefore, pressurised fuel is delivered through the both the first and second sets of outlets 40, 42 together.

In addition to the re-positioned stop member 100, the present embodiment differs from embodiments described previously in that the region of the bore 52 at the upper end of the outer valve member 34 defines a recess 114 of relatively large diameter. The recess 114 houses a helical spring 116 through which the valve carrier 56 is received such that an upper end of the spring 116 abuts the lower face of the head portion 56*a* and a lower end of the spring 116 abuts a step formation 118 provided in the recess 114. The spring 116 serves to urge the outer valve needle 34 into engagement with its seating region 50 when system fuel pressure is removed. This should be compared with the embodiments previously described in which the cooperating surface 101 of the carrier member 56 is engaged with the upper surface 102 of the stop member 100 when both the outer valve member 34 and the inner valve member 60 are seated, the outer valve member 34 being urged into engagement with its seating region 50 via the stop member 100 and spring 74 acting on the head portion 56*a* of the carrier member 56.

A further difference is that the passage 84 in the inner valve member 60 is omitted, and replaced with flats 120 on the outer surface of the inner valve member 60. The flats 120, together with the bore 52, define a communication path for fuel to flow from the first delivery chamber 48 to the second delivery chamber 113. The provision of the flats 120 on the lower end portion of the inner valve member 60 maintains a low resistance to fuel flow, whilst improving the guidance provided to the inner valve member 60.

The additional spring 116 located in the recess 114 of the outer valve member 34 could be incorporated into any of the previously described embodiments. However, it should be appreciated that a greater reduction of fuel pressure within the control chamber 28 would be necessary in order to overcome the force provided by the spring 116 and cause the outer valve member 34 to disengage it seating region 50.

It should also be appreciated that the flats 120 provided on the inner valve member 60 of this embodiment may provide an alternative to the fuel flow passages 84, 86 internal to the inner valve member 60 or the reduced diameter region 110 of FIG. 6.

Figure 8:
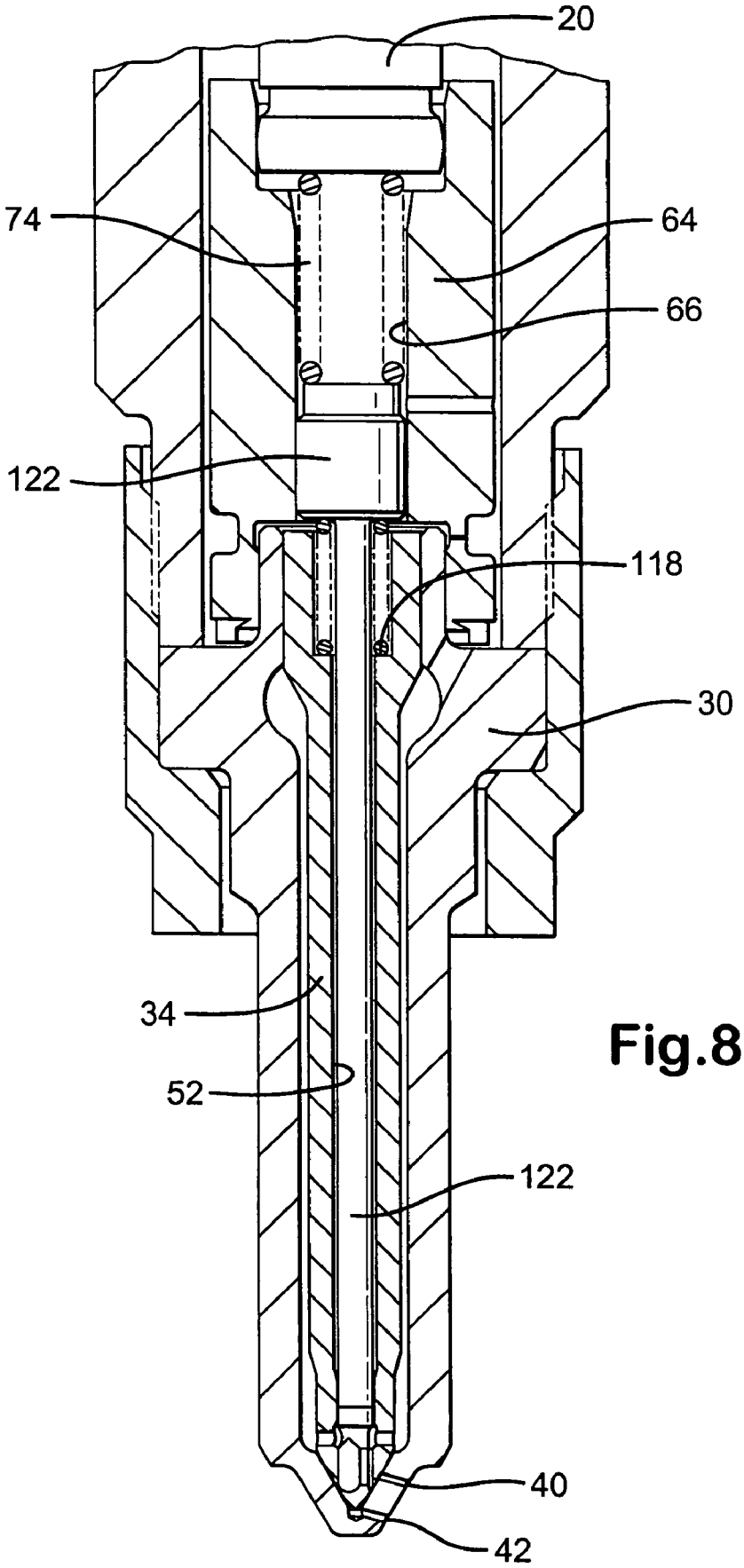
FIG. 8 is a sectional view of an injection nozzle in accordance with another embodiment of the present invention.

A further alternative embodiment, as shown in FIG. 8, provides the flexibility to selectively deliver fuel through either the first set of outlets 40 or the second set of outlets 42 exclusively. Once again, like parts are denoted by like reference numerals and only the differences between previous embodiments will be described here.

The stop member 100 is omitted and an inner valve member 122 of unitary form is provided within the bore 52 of the outer valve member 34. It should be appreciated, however, that the inner valve member 122 may not be a unitary part but may be formed from multiple parts. Since the stop member 100 is omitted, the inner valve member 122 is permitted to move independently of the outer valve member 34.

Having described particular preferred embodiments of the present invention, it is to be appreciated that the embodiments referred to are exemplary only and that variations and modifications may be made without departing from the scope of the invention as set forth in the appended claims.

For example, although the abutment surface 102 is provided by the stop member 100 it should be appreciated that the abutment surface 102 could also be provided by an appropriate formation, such as a step defined in the bore 52 of the outer valve member 34, which would cooperate with the inner valve member 60. A separate stop member 100 is generally preferred, however, since it is more convenient to manufacture and to grind accurately a lifting surface thereon.

The invention claimed is:

1. A fuel injector for use in an internal combustion engine, the fuel injector having an injection nozzle comprising:

a nozzle body being provided with a nozzle bore;

an outer valve received within the nozzle bore and being engageable with a first seating to control fuel delivery through a first set of one or more nozzle outlets, the outer valve being provided with an outer valve bore;

an inner valve received within the outer valve bore and being engageable with a second seating to control fuel delivery through a second set of one or more nozzle outlets;

an injection control chamber for fuel;

a pressure control arrangement for controlling the pressure of fuel within the injection control chamber;

a first surface associated with the inner valve which is exposed to fuel pressure within the injection control chamber; and a second surface associated with the outer valve which is exposed to fuel pressure within the injection control chamber;

wherein the first and second surfaces are arranged such that when the pressure of fuel within the injection control chamber is increased to a relatively high pressure, one of the outer valve or the inner valve is caused to disengage its respective seating and when the pressure of fuel with the injection control chamber is reduced to a relatively low pressure, the other of the outer valve or the inner valve is caused to disengage its respective seating; and wherein the inner valve is coupled to an inner valve carrier, the first surface being defined by the carrier.

2. The fuel injector as claimed in claim 1, wherein a decrease in fuel pressure within the injection control chamber causes the outer valve to disengage the first seating and wherein an increase in fuel pressure within the injection control chamber causes the inner valve to disengage the second seating.

3. The fuel injector as claimed in claim 1, wherein the pressure control arrangement includes a piezoelectric actuator having a stack of piezoelectric elements with a stack length, the stack being arranged within an accumulator volume for receiving fuel at injection pressure, whereby an increase in the length of the stack causes an increase in fuel pressure within the injection control chamber and a reduction in the length of the stack causes a reduction of fuel pressure within the injection control chamber.

4. A fuel injector for use in an internal combustion engine, the fuel injector having an injection nozzle comprising:

a nozzle body being provided with a nozzle bore;

an outer valve received within the nozzle bore and being engageable with a first seating to control fuel delivery through a first set of one or more nozzle outlets, the outer valve being provided with an outer valve bore;

an inner valve received within the outer valve bore and being engageable with a second seating to control fuel delivery through a second set of one or more nozzle outlets;

an injection control chamber for fuel;

a pressure control arrangement for controlling the pressure of fuel within the injection control chamber;

a first surface associated with the inner valve which is exposed to fuel pressure within the injection control chamber; and a second surface associated with the outer valve which is exposed to fuel pressure within the injection control chamber;

wherein the first and second surfaces are arranged such that when the pressure of fuel within the injection control chamber is increased to a relatively high pressure, one of the outer valve or the inner valve is caused to disengage its respective seating and when the pressure of fuel with the injection control chamber is reduced to a relatively low pressure, the other of the outer valve or the inner valve is caused to disengage its respective seating;

further comprising a coupling arrangement to couple movement of the outer valve to the inner valve when the outer valve is caused to move away from the first seating.

5. The fuel injector as claimed in claim 4, wherein the coupling arrangement includes an abutment surface associated with the outer valve, which is engageable with a cooperable surface associated with the inner valve.

6. The fuel injector as claimed in claim 5, wherein the abutment surface is provided by an annular stop member received within the bore of the outer valve, the abutment surface abutting the cooperable surface when both the outer valve and the inner valve are seated.

7. The fuel injector as claimed in claim 6, wherein the annular stop member defines a second surface which is spaced apart, by a predetermined distance, from a shoulder defined by the inner valve, the second surface serving to prevent movement of the inner valve away from its seating by an amount greater than the predetermined distance.

8. A fuel injector fur use in an internal combustion engine, the fuel injector having an injection nozzle comprising:

a nozzle body being provided with a nozzle bore;

an outer valve received within the nozzle bore and being engageable with a first seating to control fuel delivery through a first set of one or more nozzle outlets, the outer valve being provided with an outer valve bore;

an inner valve received within the outer valve bore and being engageable with a second seating to control fuel delivery through a second set of one or more nozzle outlets;

an injection control chamber for fuel;

a pressure control arrangement for controlling the pressure of fuel within the injection control chamber;

a first surface associated with the inner valve which is exposed to fuel pressure within the injection control chamber; and a second surface associated with the outer valve which is exposed to fuel pressure within the injection control chamber;

wherein the first and second surfaces are arranged such that when the pressure of fuel within the injection control chamber is increased to a relatively high pressure, one of the outer valve or the inner valve is caused to disengage its respective seating and when the pressure of fuel with the injection control chamber is reduced to a relatively low pressure, the other of the outer valve or the inner valve is caused to disengage its respective seating;

wherein the pressure control arrangement includes a piezoelectric actuator having a stack of piezoelectric elements with a stack length, the stack being arranged within an accumulator volume for receiving fuel at injection pressure, whereby an increase in the length of the stack causes an increase in fuel pressure within the injection control chamber and a reduction in the length of the stack causes a reduction of fuel pressure within the injection control chamber; and wherein the pressure control arrangement further includes a control piston having a surface which defines the injection control chamber, together with the first and second surfaces, and wherein the control piston is operable to control the volume of the injection control chamber.

9. The fuel injector as claimed in claim 8, wherein the control piston defines a spring chamber housing a spring serving to bias the inner valve towards the second seating.

10. The fuel injector as claimed in claim 9, further including a damping arrangement to damp movement of the inner valve as it is caused to move away from the second seating.

11. The fuel injector as claimed in claim 10, wherein the damping arrangement includes a restricted passage provided in the control piston, wherein the restricted passage fluidly connects the spring chamber to the accumulator volume.

12. The fuel injector as claimed in claim 8, further including restricted flow path for equalising pressure between the control chamber and the accumulator volume.

13. The fuel injector of claim 12, wherein the restricted flow path is provided in the control piston and fluidly connects the injection control chamber to the accumulator volume.

14. A fuel injector having an injection nozzle comprising:

a nozzle body having a nozzle bore;

an outer valve received within the nozzle bore and engageable with a first seating to control fuel delivery through a first set of one or more nozzle outlets, the outer valve being provided with an outer valve bore;

an inner valve received within the outer valve bore and engageable with a second seating to control fuel delivery trough a second set of one or more nozzle outlets;

an injection control chamber for fuel and a piezoelectric actuator for controlling the pressure of fuel within the injection control chamber;

a first surface of the inner valve being exposed to fuel pressure within the injection control chamber, and a second surface of the outer valve being exposed to fuel pressure within the injection control chamber;

wherein the first and second surfaces are arranged such that when the pressure of fuel within the injection control chamber is increased from an intermediate fuel pressure to a relatively high pressure, one of the outer valve or the inner valve is caused to disengage its respective seating and when the pressure of fuel with the injection control chamber is reduced from the intermediate fuel pressure to a relatively low pressure, the other of the outer valve or the inner valve is caused to disengage its respective seating; and wherein the inner valve is coupled to an inner valve carrier, the first surface being defined by the earner.

15. The fuel injector as claimed in claim 14, wherein a decrease in fuel pressure within the injection control chamber causes the outer valve to disengage the first seating and wherein an increase in fuel pressure within the injection control chamber causes the inner valve to disengage the second seating.

16. A fuel injector comprising:

an injection nozzle body provided with a nozzle bore;

an outer valve received within the nozzle bore for controlling fuel delivery through a first set of one or more nozzle outlets;

an inner valve received within an outer valve bore provided in the outer valve for controlling fuel delivery through a second set of one or more nozzle outlets;

an injection control chamber for fuel and a piezoelectric stack for controlling the pressure of fuel within the injection control chamber;

a first surface associated with the inner valve which is exposed to fuel pressure within the injection control chamber; and a second surface associated with the outer valve which is exposed to fuel pressure within the injection control chamber;

wherein, when the control chamber is at an intermediate fuel pressure, there is no injection through the first or second set of outlets, the first and second surfaces being arranged such that when the pressure of fuel within the injection control chamber is increased from the intermediate fuel pressure to a relatively high pressure, the inner valve is moved to allow injection through the second set of one or more nozzle outlets and when the pressure of fuel with the injection control chamber is reduced from the intermediate fuel pressure to a relatively low pressure, the outer valve is moved to allow injection through the first set of one or more nozzle outlets, the injector further comprising a coupler to couple movement of the outer valve to the inner valve when the outer valve is caused to move.

17. The fuel injector as claimed in claim 16, wherein the coupler includes an abutment surface associated with the outer valve, which is engageable with a cooperable surface associated with the inner valve.

* * * * *